US011344176B2

(12) United States Patent
Hodapp, Jr.

(10) Patent No.: US 11,344,176 B2
(45) Date of Patent: May 31, 2022

(54) DISHWASHER APPLIANCES AND METHODS FOR DETERMINING WASH ADDITIVE LEVELS

(71) Applicant: Haier US Appliance Solutions, Inc., Wilmington, DE (US)

(72) Inventor: Leo Edward Hodapp, Jr., Greenville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 231 days.

(21) Appl. No.: 16/654,438

(22) Filed: Oct. 16, 2019

(65) Prior Publication Data

US 2021/0113051 A1 Apr. 22, 2021

(51) Int. Cl.

*A47L 15/00* (2006.01)
*A47L 15/42* (2006.01)
*A47L 15/44* (2006.01)

(52) U.S. Cl.

CPC ..... *A47L 15/0055* (2013.01); *A47L 15/4259* (2013.01); *A47L 15/44* (2013.01); *A47L 2401/023* (2013.01); *A47L 2401/26* (2013.01); *A47L 2501/07* (2013.01); *A47L 2501/26* (2013.01)

(58) Field of Classification Search

CPC ..... A47L 15/0055; A47L 15/4257; A47L 15/4259; A47L 2401/023; A47L 2401/26; A47L 2501/07; A47L 2501/22; A47L 2501/26

See application file for complete search history.

(56) References Cited

U.S. PATENT DOCUMENTS

| | | | |
|---|---|---|---|
| 4,141,311 | A | 2/1979 | Taylor, Jr. |
| 5,151,884 | A | 9/1992 | Griffith et al. |
| 7,610,922 | B2 | 11/2009 | Marone et al. |
| 8,210,188 | B2 | 7/2012 | Wilcox et al. |
| 8,968,486 | B2 | 3/2015 | Allen et al. |
| 9,378,630 | B2 | 6/2016 | Smith |
| 2007/0246069 | A1 | 10/2007 | Elick et al. |
| 2010/0294323 | A1* | 11/2010 | Brunswick ..... A47L 15/4291 134/56 D |

(Continued)

FOREIGN PATENT DOCUMENTS

| | | | |
|---|---|---|---|
| DE | 3513640 | C2 | 10/1986 |
| DE | 102010002715 | A1 | 9/2011 |

(Continued)

OTHER PUBLICATIONS

DE3513640—Machine Translation (Year: 1986).*

*Primary Examiner* — Marc Lorenzi
(74) *Attorney, Agent, or Firm* — Dority & Manning, P.A.

(57) ABSTRACT

A method of operating a dishwasher appliance, as provided herein, may include detecting a door of the dishwasher appliance in an open position and determining the door is maintained in the open position for a preset minimum continuous period. The method may further include detecting the door in a closed position following the preset minimum continuous period. The method may still further include measuring an additive volume of a wash additive in an additive compartment on the door while the door is in the closed position following the preset minimum continuous period.

7 Claims, 7 Drawing Sheets

(56) References Cited

U.S. PATENT DOCUMENTS

| | | | | |
|---|---|---|---|---|
| 2012/0125366 | A1* | 5/2012 | Beshears, Jr. ..... | A47L 15/4293<br>134/18 |
| 2016/0296100 | A1 | 10/2016 | Andersson et al. | |
| 2017/0065148 | A1* | 3/2017 | Kan ..... | A47L 15/449 |

FOREIGN PATENT DOCUMENTS

| | | | |
|---|---|---|---|
| DE | 10028630 | B4 | 9/2016 |
| EP | 1637060 | A2 | 3/2006 |
| EP | 2471432 | B1 | 10/2015 |
| ES | 2336474 | T3 | 4/2010 |

* cited by examiner

DISHWASHER APPLIANCES AND METHODS FOR DETERMINING WASH ADDITIVE LEVELS

FIELD OF THE INVENTION

The present subject matter relates generally to dishwasher appliances, and more particularly to dishwasher appliances and methods for determining a level or volume of wash additive within an appliance that is available to be dispensed.

BACKGROUND OF THE INVENTION

Dishwasher appliances generally include a tub that defines a wash compartment. Rack assemblies can be mounted within the wash compartment of the tub for receipt of articles for washing. In a typically known dishwasher appliance, spray assemblies within the wash compartment can apply or direct wash fluid towards articles disposed within the rack assemblies in order to clean such articles. Multiple spray assemblies can be provided including, for example, a lower spray arm assembly mounted to the tub at a bottom of the wash compartment, a mid-level spray arm assembly mounted to one of the rack assemblies, or an upper spray assembly mounted to the tub at a top of the wash compartment.

In order to facilitate cleaning of articles in a dishwasher appliance, cleaning agents or wash additives are used. During operation of the dishwasher appliance, the wash additives generally mix with water in the wash compartment to form a fluid that is used to clean articles within the wash compartment. Wash additives include, for example, detergents and rinse agents. In some cases, liquid wash additives are used.

For some existing appliances, wash additives are stored one or more reservoirs defined in the doors of dishwasher appliances and are dispensed from these reservoirs during operation of the dishwasher appliance. However, it can be difficult for a user to determine the amount of wash additive that is present within a reservoir. The user may be unaware of how much wash additive should be provided, or the dishwasher may be unable to dispense the necessary amount to clean a given load of articles within the wash compartment. Previous attempts have been made to include one or more sensors to automatically detect the amount or volume of wash additive within a reservoir. These attempts have largely proved unsatisfactory due to certain drawbacks that arise with typical use of a dishwasher. For example, opening-closing the door may cause a volume of wash additive within the door to move, often while leaving residue or portions of the wash additive at various areas of the reservoir. This may, in turn, obscure or inaccurately influence subsequent sensor readings.

As a result, it may be useful to provide a dishwasher appliance or method that can address one or more of the above identified issues. In particular, it would be advantageous to have a dishwasher appliance or method for readily and accurately detecting a level or volume of wash additive within the dishwasher appliance.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a dishwasher appliance is provided. The method may include detecting a door of the dishwasher appliance in an open position and determining the door is maintained in the open position for a preset minimum continuous period. The method may further include detecting the door in a closed position following the preset minimum continuous period. The method may still further include measuring an additive volume of a wash additive in an additive compartment on the door while the door is in the closed position following the preset minimum continuous period.

In another exemplary aspect of the present disclosure, a dishwasher appliance is provided. The dishwasher appliance may include a cabinet, a tub, a door, an additive sensor, and a controller. The tub may be mounted within the cabinet and defining a wash chamber for receipt of articles for washing. The door may be movably mounted to the cabinet. The cabinet may be movable between a closed position restricting access to the wash chamber and an open position permitting access to the wash chamber. The door may define an additive compartment to selectively receive an additive volume of wash additive therein. The additive sensor may be mounted to the door in communication with the additive compartment to detect the additive volume. The controller may be operably coupled to the additive sensor. The controller may be configured to initiate a detection operation that includes detecting the door in the open position, determining the door is maintained in the open position for a preset minimum continuous period, detecting the door in the closed position following the preset minimum continuous period, and measuring the additive volume in the additive compartment based on a level signal received from the additive sensor while the door is in the closed position following the preset minimum continuous period.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
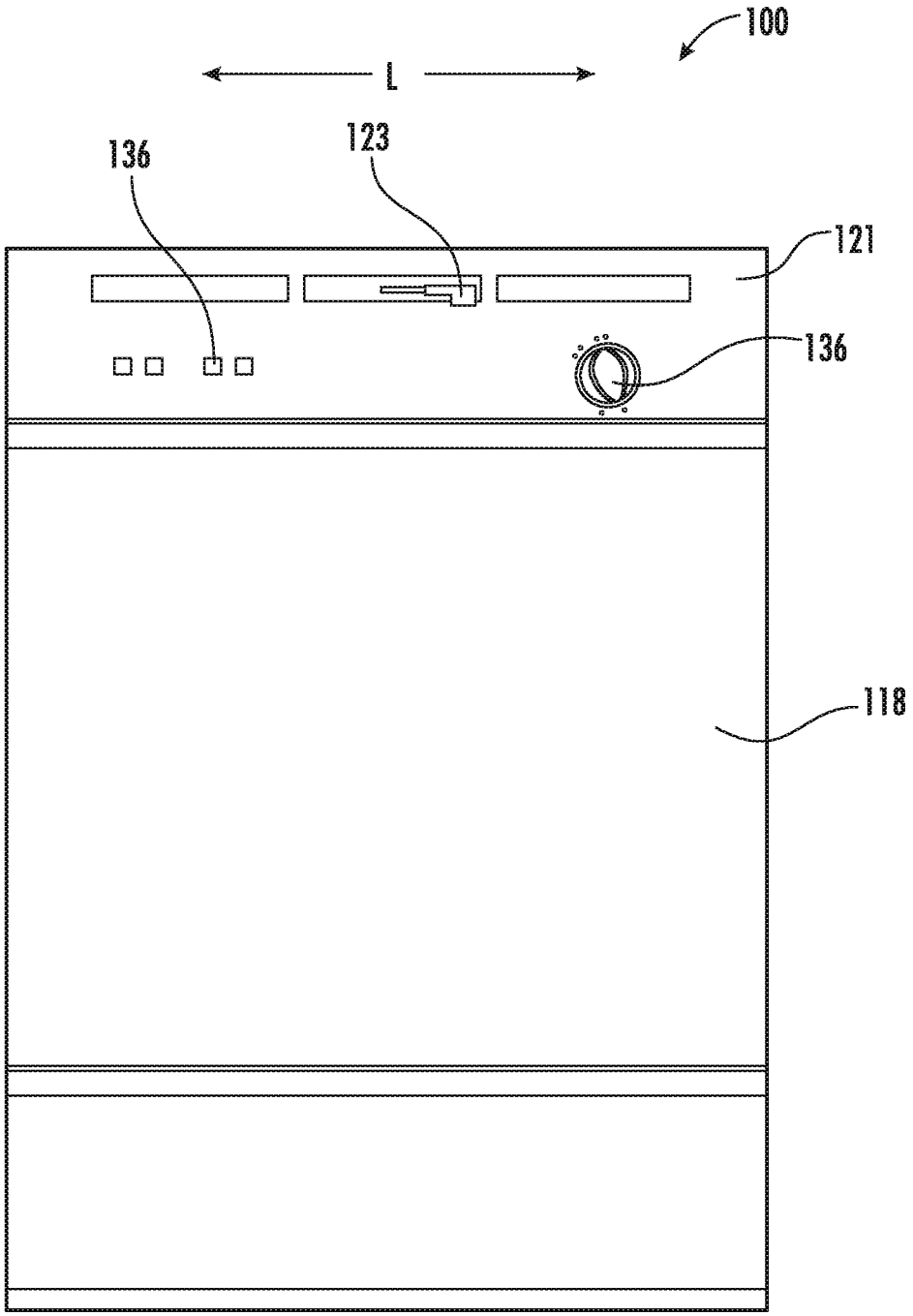
FIG. 1 provides a front elevation view of a dishwasher appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
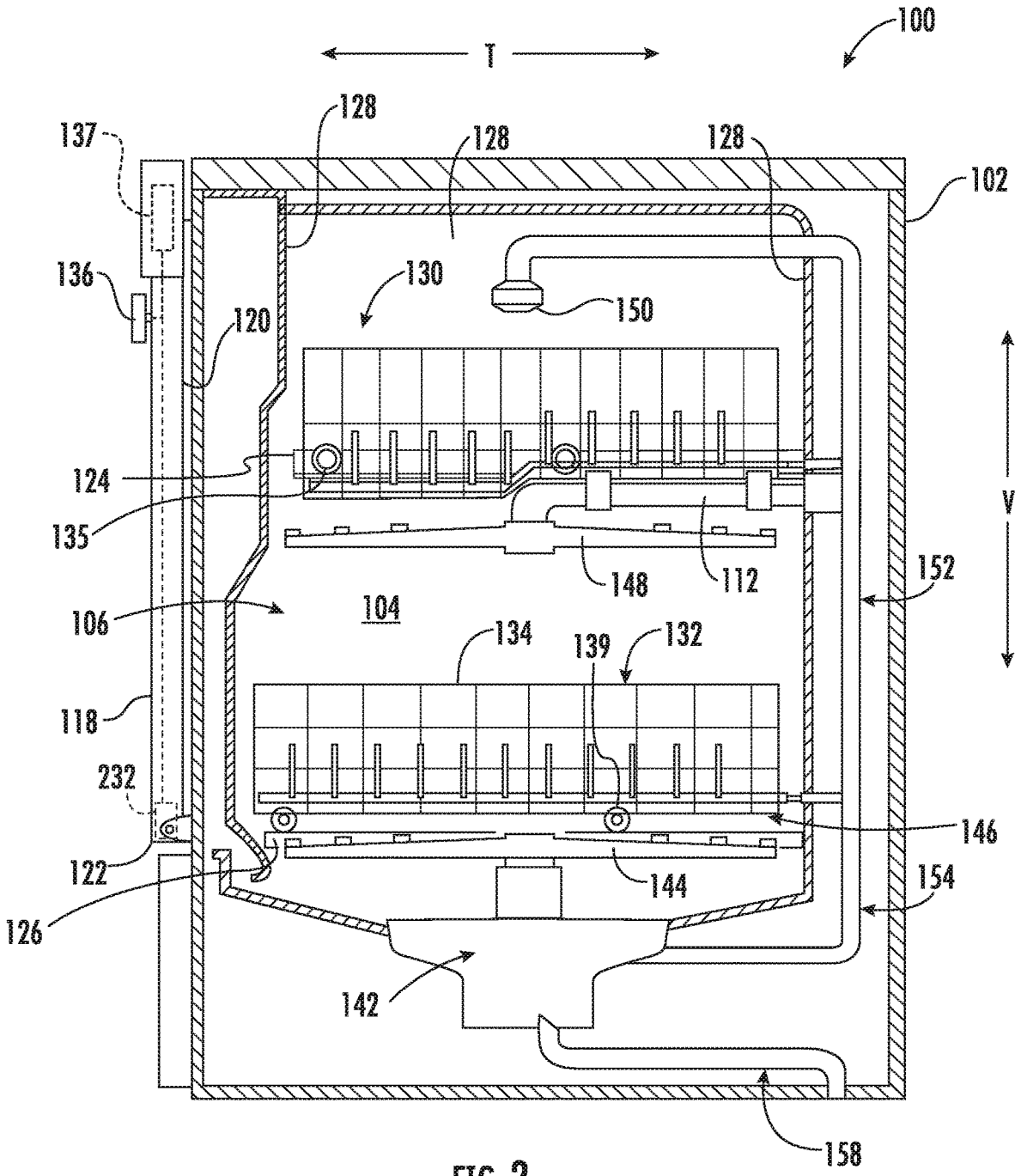
FIG. 2 provides a schematic sectional view of the exemplary dishwasher appliance of FIG. 1.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses water or detergent to, for example, remove soil particles including food and other undesirable elements from the articles FIGS. 1 and 2 depict an exemplary domestic dishwasher 100 that may be configured in accordance with aspects of the present disclosure. As shown, the dishwasher 100 includes a cabinet 102 having a tub 104 mounted therein that defines a wash chamber 106. Tub 104 includes a plurality of sidewalls 128 that define the wash chamber 106. The tub 104 further includes a front opening and a door 118 hinged at its bottom 122 for movement between a closed (e.g., vertical) position (shown in FIGS. 1 and 2), wherein the wash chamber 106 is sealed shut for a washing operation or wash cycle, and an opened (e.g., fully or partially open) position (e.g., FIG. 6C) for loading and unloading of articles from the dishwasher 100. Thus, access to wash chamber 106 is generally restricted in the closed position, while access to wash chamber 106 is permitted in the opened position. In some embodiments, a latch 123 is used to lock and unlock door 118 for access to chamber 106. Door 118 includes an inner wall 120. The inner wall 120 further defines the wash chamber 106 when the door 118 is in the closed position.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack assembly 130, 132 is arranged in the wash chamber 106, such that the rack assembly 130, 132 is capable of movement between an extended loading position (not shown) in which the rack is substantially positioned outside the wash chamber 106, and a retracted position (shown in FIGS. 1 and 2) in which the rack is located inside the wash chamber 106. This is, for example, facilitated by rollers 135 and 139, for example, mounted onto rack assemblies 130 and 132, respectively. A silverware basket (not shown) may be removably attached to rack assembly 132 for placement of silverware, utensils, and the like, that are otherwise too small to be accommodated by the rack assemblies 130, 132.

In some embodiments, the dishwasher 100 further includes a lower spray-arm assembly 144 that is rotatably mounted within a lower region 146 of the wash chamber 106 and above a sump 142 so as to rotate in relatively close proximity to rack assembly 132. In some embodiments, a mid-level spray-arm assembly 148 is located in an upper region of the wash chamber 106 and may be located in close proximity to upper rack 130. Additionally or alternatively, an upper spray assembly 150 may be located above the upper rack 130.

Each spray-arm assembly 144, 148 includes an arrangement of discharge ports or orifices for directing fluid onto dishes or other articles located in rack assemblies 130 and 132. The arrangement of the discharge ports in spray-arm assemblies 144, 148 provides a rotational force by virtue of washing fluid flowing through the discharge ports. The resultant rotation of the spray-arm assemblies 144, 148 and the operation of spray assembly 150 provides coverage of dishes and other dishwasher contents with a washing spray. Other configurations of spray assemblies may be used as well.

The lower and mid-level spray-arm assemblies 144, 148 and the upper spray assembly 150 may be provided as part of a fluid circulation assembly 152 for circulating water and dishwasher fluid in the tub 104. In some embodiments, fluid circulation assembly 152 includes a circulation conduit 154 that supplies the fluid to the lower and mid-level spray-arm assemblies 144, 148 or the upper spray assembly 150. The conduit 154 may, for example, be in fluid communication with the sump 142 such that fluid can flow from the sump 142 into the conduit 154 as required.

As noted above, dishwasher assembly 100 further includes sump 142, which may be provided in lower region 146 below, for example, lower spray-arm assembly 144. Sump 142 generally collects fluid from the wash chamber 106 for circulation within the tub 104, such as back into the wash chamber 106 through fluid circulation assembly 152, as well as drainage from the tub 104 and dishwasher appliance 100 in general. Drainage may occur, for example, through a drain conduit 158 that is provided for draining fluid from the sump 142. The conduit 158 may, for example, be in fluid communication with the sump 142 such that fluid can flow from the sump 142 into the conduit 158 as required. Drain conduit 158 may flow the fluid from the sump 142 to, for example, external plumbing or another suitable drainage location.

As shown, dishwasher 100 is further equipped with a controller 137 to regulate operation of the dishwasher 100. The controller may include one or more memory devices and one or more microprocessors, such as general or special purpose microprocessors operable to execute programming instructions or micro-control code associated with a wash cycle. The memory may represent random access memory such as DRAM, or read only memory such as ROM or FLASH. In some embodiments, the processor executes programming instructions stored in memory. For certain embodiments, the instructions include a software package configured to operate appliance 100 and, for example, initiate or execute the exemplary method 700 described below with reference to FIG. 7. The memory may be a separate component from the processor or may be included onboard within the processor.

The controller 137 may be positioned in a variety of locations throughout dishwasher 100. For instance, the controller 137 may be located within a control panel area 121 of door 118 as shown in FIGS. 1 and 2. In such an embodiment, input/output ("I/O") signals may be routed between the control system and various operational components of dishwasher 100 along wiring harnesses that may be routed through the bottom 122 of door 118. Typically, the controller 137 includes a user interface panel or controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiments depicted in FIGS. 1 and 2 are for illustrative purposes only. For example, different locations may be provided for user interface 136, different configurations may be provided for racks 130, 132, and other differences may be applied as well.

Figure 3:
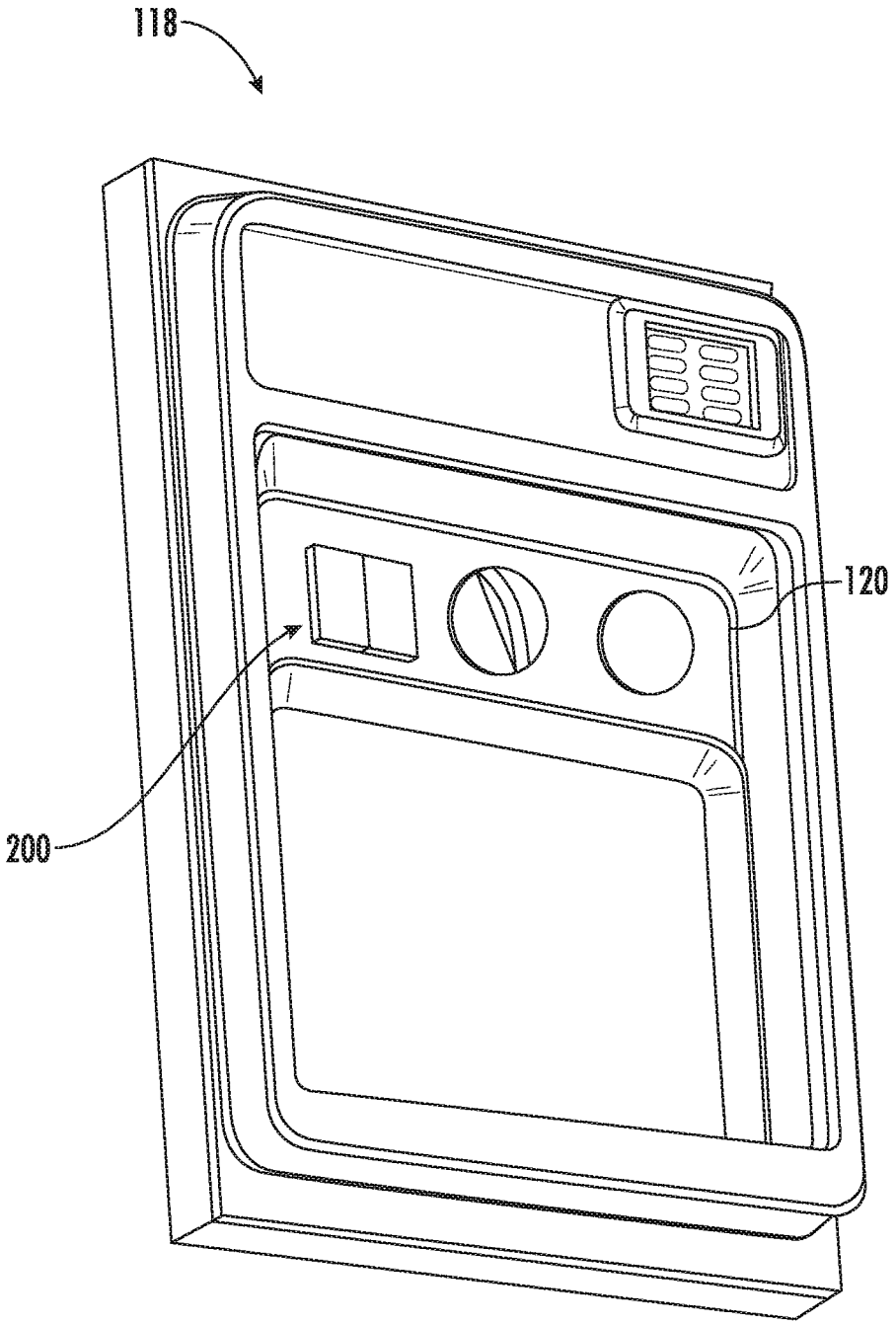
FIG. 3 provides a perspective view of a door for a dishwasher appliance according to exemplary embodiments of the present disclosure.

Turning briefly to FIG. 3, a perspective view is provided for a door 118, such as that for dishwasher 100 (FIGS. 1 and 2). In some embodiments, an additive module 200 is provided at or on an inner portion of door 118 to receive and dispense a volume of wash additive (e.g., rinse aid, liquid cleaning agent, etc.) to the wash chamber 106. In particular, additive module 200 may be attached to the inner wall 120 of the door 118. A hole or aperture defined through the inner wall 120 may receive or otherwise define an opening for fluid communication with a reservoir or additive compartment 210 (FIGS. 4 and 5) of the additive module 200, as will be described below. Thus, additive module 200 may be fixed to the door 118 and thereby move with the door 118 (e.g., as it is moved between the open and closed positions).

Figure 4:
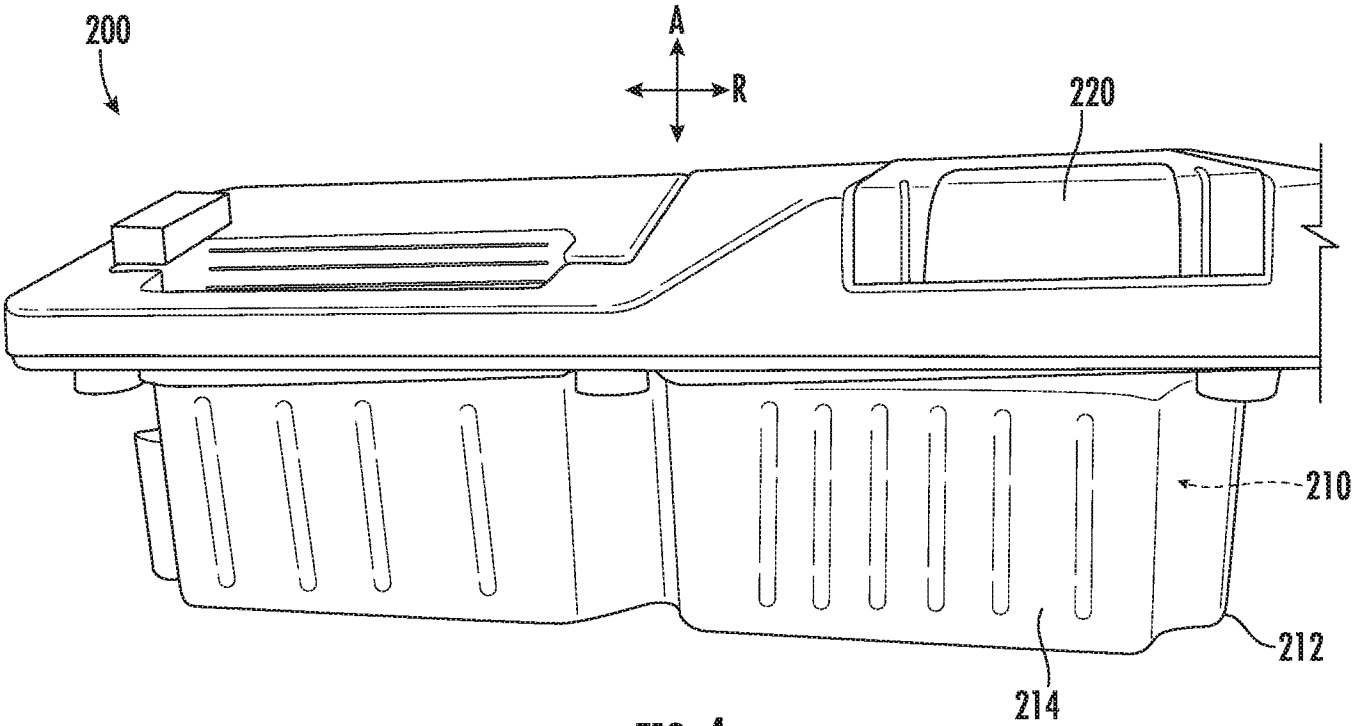
FIG. 4 provides a side perspective view of an additive module for a door of a dishwasher appliance according to exemplary embodiments of the present disclosure.
Figure 5:
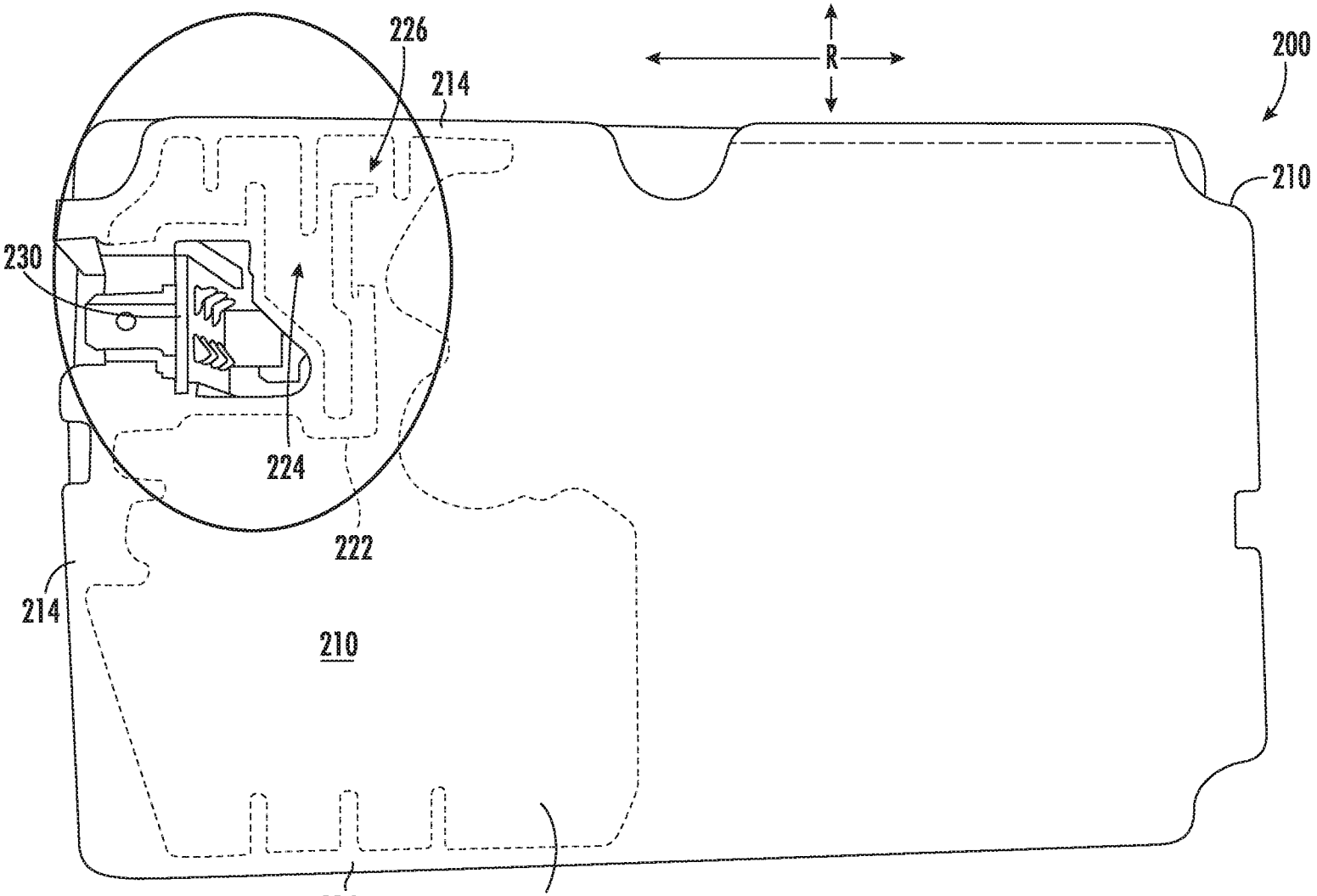
FIG. 5 provides a bottom perspective view of the exemplary additive module of FIG. 4.

Turning now generally to FIGS. 4 and 5, various views are provided of an additive module 200 according to exemplary embodiments of the present disclosure. As shown, additive module 200 includes a retaining cup 212 defining at least one additive compartment 210 to receive or hold a volume of wash additive therein. Retaining cup 212 includes one or more sidewalls 214 that generally extend along an axial direction A. In particular, sidewalls 214 may extend in the axial direction A between a front and a back end (e.g., parallel to the axial direction A or at an otherwise non-perpendicular angle relative thereto). A base wall 216 of retaining cup 212 may extend across the axial direction A (e.g., along the radial direction R perpendicular to the axial direction A) from the one or more sidewalls 214. In turn, the base wall 216 may connect the one or more sidewalls 214 and partially enclose the additive compartment 210. In optional embodiments, a discrete interior wall 222 extends from base wall 216 within compartment 210. As shown, interior wall 222 may be positioned between a first and a second segment of sidewall 214. Moreover, interior wall 222 may be curved to define an open sub-chamber 224 (i.e., secondary subchamber) within compartment 210. Generally, sub-chamber 224 is in fluid communication with the rest of compartment 210 (e.g., through an inlet 226), but may separately hold a portion of the volume of wash additive above the rest of the volume within compartment 210. For instance, when door 118 is in the closed position, interior wall 222 may be oriented such that the curve of interior wall 222 extends downward below inlet 226, locating sub-chamber 224 above the rest of compartment 210. By contrast, when door 118 is in the fully open position (e.g., horizontal position), interior wall 222 may be oriented such that the curve of interior wall 222 extends forward from inlet 226, permitting the equilibrium of wash additive throughout the entirety of compartment 210. In other words, the portion of wash additive within sub-chamber 224 is permitted to reach the same level or vertical height as the portion of wash additive within the rest of compartment 210 (i.e., the primary subchamber).

A front opening may be defined by the one or more sidewalls 214 opposite of the base wall 216. Optionally, a separate dispensing outlet (not shown) may be provided through sidewalls 214 or base wall 216 for the selective release of wash additive or cleaning agent to the wash tub 106. As shown, retaining cup 212 is formed as an open box in exemplary embodiments. Nonetheless, any other suitable shape for receiving and containing liquids, such as a cleaning agent, may be provided in alternative embodiments.

As noted above, the additive module 200 may be mounted to the door 118 (FIG. 3) to move or rotate therewith. In some embodiments, when door 118 is in the closed position, the axial direction A may be parallel to the transverse direction T and perpendicular to vertical direction V (FIG. 2). By contrast, when the door 118 is in the fully open position, the axial direction A may be parallel to the vertical direction V and perpendicular to the transverse direction T.

In certain embodiments, a front cover 220 is provided to selectively cover or close additive compartment 210. For instance, the front cover 220 may be selectively placed over the front opening, enclosing additive compartment 210 and restricting access thereto. Thus, when the door 118 (FIG. 2) is in the closed position, the front cover 220 is positioned between additive compartment 210 and wash chamber 106. Generally, front cover 220 may be provided as any movable (e.g., pivotable) and nonpermeable body to selectively cover the front opening. In some embodiments, front cover 220 is formed as a plastic or rubber member selectively held to retaining cup 212 by a releasable latch. When desired, such as when adding wash additive to additive compartment 210, front cover 220 may be moved apart (e.g., pivoted away) from front opening or otherwise adjusted such that access to additive compartment 210 is permitted.

In certain embodiments, an additive sensor 230 is mounted to door 118 or additive module 200 (e.g., operably coupled in electrical or wireless communication with controller 137) to detect the amount or volume of wash additive within additive compartment 210. As an example, additive sensor 230 may be provided as an optical sensor mounted to retaining cup 212 outside of compartment 210. The optical sensor may direct or detect light transmitted through a portion of sidewall 214. Based on one or more corresponding light signals, the optical sensor may then detect the level or vertical height of wash additive within compartment 210, as would be understood. In some embodiments, additive sensor 230 is aligned with sub-chamber 224. Additive sensor 230 may thus use the level or vertical height of wash additive within sub-chamber 224 to indicate or measure an amount or volume of wash additive within the entirety of compartment 210 (e.g., when door 118 is in the closed position).

It is noted that alternative embodiments of additive sensor 230 may be provided as another suitable structure located on or near compartment 210 to detect the amount or volume of wash additive within compartment 210, such as a pressure sensor, capacitance sensor, conductivity sensor, etc.

Figure 6C:
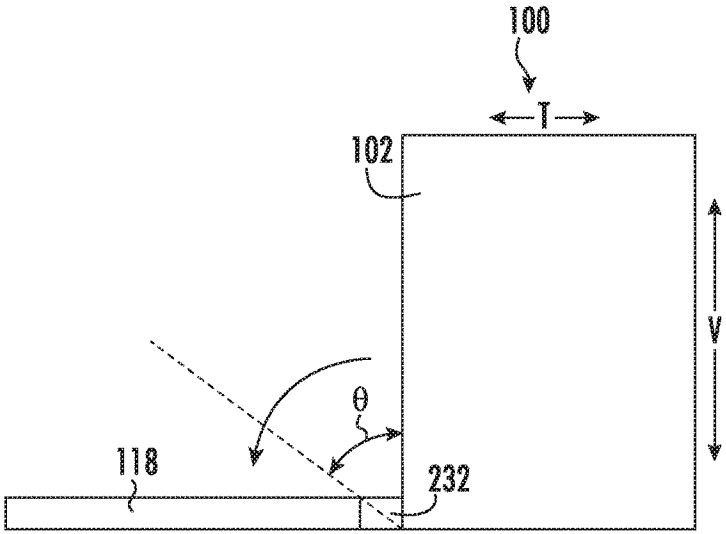
FIG. 6C provides a schematic elevation view of a dishwasher appliance according to exemplary embodiments of the present disclosure, wherein the door of the dishwasher appliance is in a fully opened position.
Figure 6B:
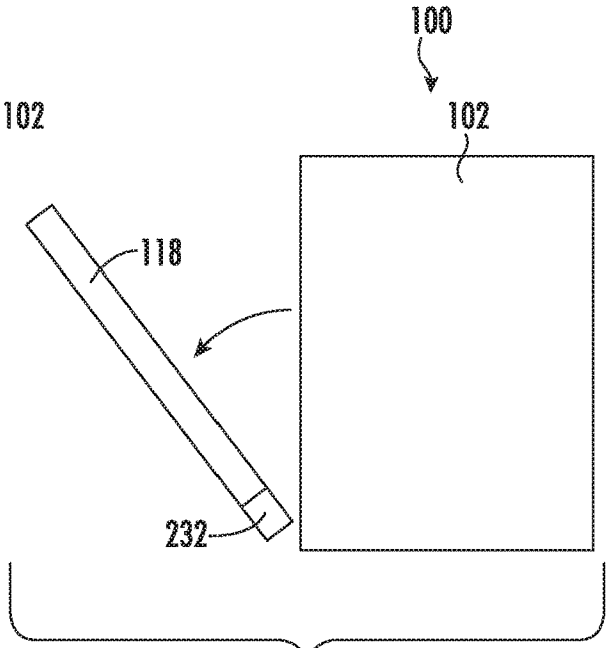
FIG. 6B provides a schematic elevation view of a dishwasher appliance according to exemplary embodiments of the present disclosure, wherein the door of the dishwasher appliance is in an intermediate position.
Figure 6A:
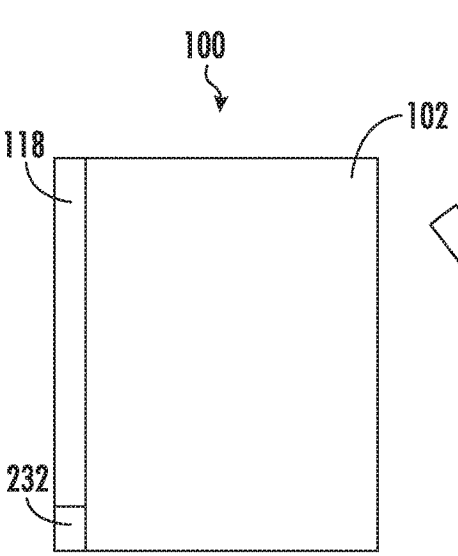
FIG. 6A provides a schematic elevation view of a dishwasher appliance according to exemplary embodiments of the present disclosure, wherein the door of the dishwasher appliance is in a closed position.

Turning now to FIGS. 6A, 6B, and 6C, various schematic elevation views are provided of dishwasher appliance 100 in a closed position, partially open (e.g., intermediate) position, and fully open (e.g., opened) position, respectively.

In some embodiments, a position sensor 232 is provided on dishwasher appliance 100 on or in communication with door 118. In particular, position sensor 232 may be configured to detect one or more positions of door 118. For instance, position sensor 232 may be in communication (e.g., electric or wireless communication) with controller 137 to generate one or more signals indicating what position door 118 is currently in or has recently reached. Position sensor 232 may thus detect or determine if door 118 is in the closed position, opened position, or one or more intermediate positions between the closed position and the opened position.

Generally, position sensor 232 is configured to detect movement or the static position of the door 118 relative to the vertical direction V. Optionally, position sensor 232 may be or include an accelerometer, which measures translational motion along one or more directions. Additionally or alternatively, position sensor 232 may be or include a gyroscope, which measures rotational motion or position about an axis. Also additionally or alternatively, position sensor 232 may be or include another suitable device capable of detecting or measuring an angle of door 118 relative to the vertical direction V, such as a potentiometer (e.g., mounted at the hinge of door 118), a limit switch (e.g., mechanical or magnetic switch in selective engagement with the door 118 at a set position or threshold), a rotary encoder (e.g., optical sensor, a Hall effect sensor, etc.), a load cell, or a strain gauge.

In certain embodiments, position sensor 232 is configured to detect if or when door 118 reaches or exceeds a predetermined minimum angle θ relative to the vertical direction V. As shown, when door 118 is in the closed position, the door 118 defines an angle of 0° relative to the vertical direction V. By contrast, when door 118 is in the opened position, the door 118 may define an angle of 90° relative to the vertical direction V. The predetermined minimum angle θ may be defined as an angle (e.g., angle value or range of values) greater than 0°, but less than or equal to 90°. Thus, position sensor 232 may detect or indicate that the door 118 has at least been moved from the closed position and opened to the predetermined minimum angle θ. In some such embodiments, the predetermined minimum angle θ is greater than 45° (e.g., greater than 45° and less than or equal to 90°). In additional or alternative embodiments, the predetermined minimum angle θ is greater than 80° (e.g., greater than 80° and less than or equal to 90°).

Figure 7:
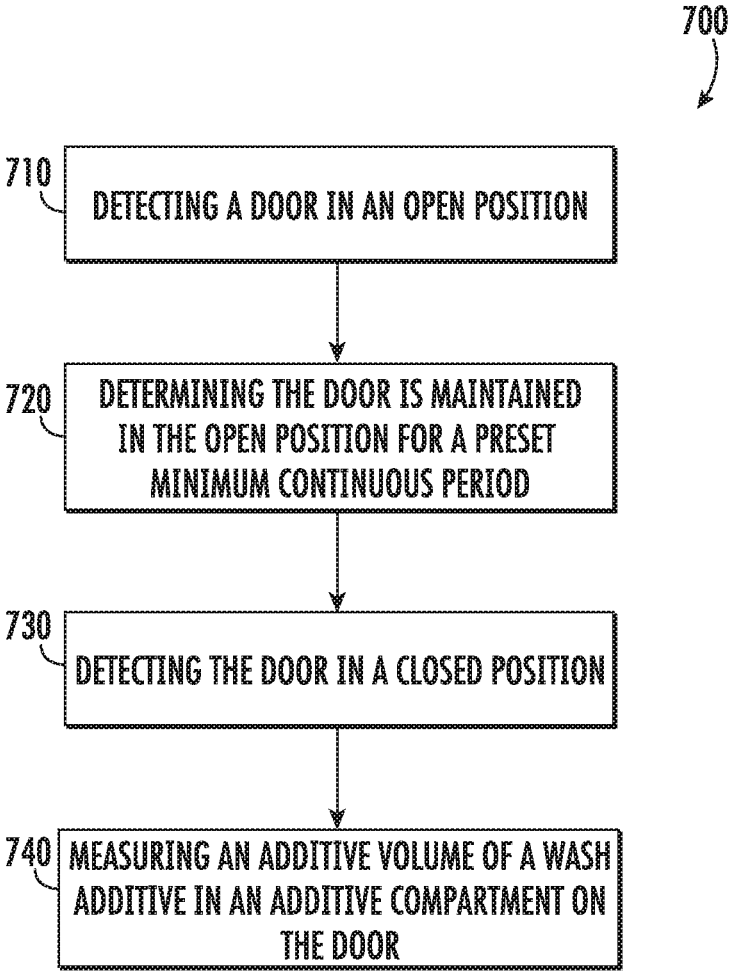
FIG. 7 provides a flow chart illustrating a method of operating a dishwashing appliance, according to exemplary embodiments of the present disclosure.

Turning now to FIG. 7, methods (e.g., method 700) for operating a dishwasher appliance are illustrated. Method 700 may be used to operate any suitable dishwasher appliance. As an example, some or all of method 700 may be used to operate dishwasher appliance 100 (FIG. 1). The controller 137 (FIG. 2) may be programmed to implement some or all of method 700.

Advantageously, the methods described or otherwise indicated in the present disclosure may ensure an accurate level or volume of wash additive within the dishwasher appliance 100 (e.g., within an additive compartment 210) is measured.

As shown, at 710, the method 700 includes detecting a door of the dishwasher appliance in an open position. The open position of 710 may be a fully open position or, alternatively, a partially open position. In some embodiments, 710 includes receiving one or more position signals from a position sensor mounted to the door, as described above. The position signal(s) may indicate a relative position of the door between the closed position and the open position. For instance, the position signals may be transmitted as an absolute measurement of door position or as an indication that the door has reached one or more predetermined thresholds between the closed position and the open position. The position signals may be transmitted, for example, to a controller at a set rate, in response to an interrogation signal, or in response to door reaching a predetermined threshold.

In optional embodiments, 710 includes detecting the door below a predetermined minimum angle relative to a vertical direction. As an example, 710 may include measuring a position of the door and comparing the measured position to the predetermined minimum angle. As an additional or alternative example, 710 may include receiving a threshold position signal in response to the door being moved to the predetermined minimum angle. Optionally, the predetermined angle may be greater than 45 degrees or 80 degrees, as described above.

At 720, the method 700 includes determining the door is maintained in the open position for a preset minimum continuous period (e.g., span of time, as may be defined in seconds or minutes). The preset minimum continuous period may begin (e.g., be initiated) once the door is detected in the open position and end (e.g., be determined to expire) some predefined amount of time later. Thus, 720 may follow 710 and require that the door remain in a position that is at least as open as was detected at 710. The determination may be based solely on a single position signal (e.g., received at 710) or, alternatively, on multiple position signals received following 710. In some embodiments, 720 includes detecting the door below the predetermined minimum angle for the entirety of the preset minimum continuous period. For instance, 720 may require that no subsequent position signals be received to indicate that the door has been raised above the predetermined minimum threshold (e.g., the angle defined by the door is not less than the predetermined minimum threshold) following 710 and prior to the expiration of the preset minimum continuous period. Additionally or alternatively, 720 may require that one or more subsequent signals be received to indicate that the door remains below the predetermined minimum threshold (e.g., the angle defined by the door is greater than or equal to the predetermined minimum threshold) following 710 and prior to the expiration of the preset minimum continuous period.

At 730, the method 700 includes detecting the door in a closed position following the preset minimum continuous period. Optionally, during 730, one or more additional position signals may be received from the position sensor. For instance, 730 may include receiving an additional position signal, measuring an additional position of the door based on the received position signal, and comparing the measured additional position to a predetermined closed threshold. Additionally or alternatively, 730 may include receiving an additional position signal from another position sensor or switch (e.g., included on the latch to lock the door shut).

In some embodiments, 730 requires that the closed position be the only new position detected following 720. Thus, 730 may require that no intervening positions be detected prior to the closed position being reached. For instance, 730 may require that the door not be moved below the predetermined minimum threshold once being raised above the predetermined minimum threshold before the door reaches the closed position.

At 740, the method 700 includes measuring an additive volume of a wash additive in an additive compartment on the door while the door is in the closed position following the preset minimum continuous period. In other words, 740 follows 730. In some embodiments, 740 includes receiving a level signal from the additive sensor mounted to the door, as described above. From the level signal, a height or volume of wash additive within at least a portion of the additive compartment is indicated. In turn, the additive volume may be measured or otherwise calculated.

In certain embodiments, 740 may be conditioned on the preset minimum continuous period being fulfilled at 720. Thus, if the door is not open for the entirety of the preset minimum continuous period, the method may prohibit a measurement of additive volume from being made.

In additional or alternative embodiments, 740 may include determining the door is maintained in the closed position for a secondary preset minimum continuous period (e.g., span of time, as may be defined in seconds or minutes) prior to receiving a level signal from the additive sensor. The secondary preset minimum continuous period may begin (e.g., be initiated) once the door is detected in the closed position at 730 and end (e.g., be determined to expire) some predefined amount of time later. The determination may be based solely on a single signal (e.g., received at 730) or, alternatively, on multiple signals received following 730.

In further additional or alternative embodiments, 740 includes recording the measured level (e.g., within the memory of controller). The measured level may establish a reading or estimation of the wash additive volume within the wash compartment that the dishwasher appliance or user may rely on for future operations. For instance, the measured level may be projected or indicated on the user interface of the dishwasher appliance. Additionally or alternatively, certain subsequent steps (e.g., releasing a portion of the wash additive to the wash chamber) may be based on the recorded measured level.

Although described in terms of a single event, the method 700 may repeat certain steps to make additional measurements of wash additive following 740 or prevent such measurements from being made in order to maintain an accurate estimation of the wash additive volume. For instance, 700 may include detecting the door moving from the closed position following 730 or 740. This detection may be, for instance, based on one or more position signals received from the position sensor, similar to 720. Following the door moving to the closed position, the method 700 may include determining the door fails to move below the predetermined minimum threshold. This determination may be based on received signal or the absence of a received signal. Thus, after moving from the closed position, the door may be held in a partially open position (e.g., above the predetermined threshold) or subsequently moved back to the closed position. In response to determining that the door fails to move below the predetermined threshold, the recorded measured level (e.g., at 740) may be maintained. Thus, the method 700 may avoid remeasuring the wash additive within the wash compartment.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, the dishwasher appliance comprising:

a cabinet;

a tub mounted within the cabinet and defining a wash chamber for receipt of articles for washing;

a door movably mounted to the cabinet, the door being movable between a closed position restricting access to the wash chamber and an open position permitting access to the wash chamber, the door defining an additive compartment to selectively receive an additive volume of wash additive therein;

a position sensor mounted to the door, the position sensor being configured to detect positions of the door, an additive sensor mounted to the door in communication with the additive compartment to detect the additive volume; and a controller operably coupled to the additive sensor, the controller being configured to direct a detection operation comprising:

detecting the door in the open position using the position sensor, determining the door is maintained in the open position for a preset minimum continuous period, detecting the door in the closed position using the position sensor following the preset minimum continuous period, measuring the additive volume in the additive compartment based on a level signal received from the additive sensor while the door is in the closed position following the preset minimum continuous period, wherein measuring the additive volume comprises recording a first measured level of the additive volume, detecting the door moving from the closed position using the position sensor following detecting the door in the closed position, determining the door fails to move below a predetermined minimum threshold following detecting the door moving from the closed position, and maintaining the recorded first measured level in response to determining the door fails to move below the predetermined minimum threshold.

2. The dishwasher appliance of claim 1, wherein detecting the door in the open position comprises detecting the door below a predetermined minimum angle relative to the vertical direction.

3. The dishwasher appliance of claim 2, wherein the predetermined minimum angle is greater than 45 degrees.

4. The dishwasher appliance of claim 3, wherein the predetermined minimum angle is greater than 80 degrees.

5. The dishwasher appliance of claim 2, wherein determining the door is maintained in the open position comprises detecting the door below the predetermined minimum angle for an entirety of the preset minimum continuous period.

6. The dishwasher appliance of claim 1, wherein measuring the additive volume comprises receiving a level signal from the additive sensor mounted to the door.

7. The dishwasher appliance of claim 1, wherein measuring the additive volume is conditioned on determining the door is maintained in the open position for the preset minimum continuous period.

* * * * *